United States Patent [19]

Rogers et al.

[11] Patent Number: 4,823,568

[45] **Date of Patent: * Apr. 25, 1989**

[54] ANTI-THEFT APPARATUS FOR A RIDING SADDLE

[76] Inventors: Kermett A. Rogers, 7220 Hooper Rd., Baton Rouge, La. 70811; Robert C. Tucker, 10229 Veranda Ct.; Mani Iyer, 1843 General Lee Ave., both of Baton Rouge, La. 70810

[ * ] Notice: The portion of the term of this patent subsequent to Aug. 4, 2004 has been disclaimed.

[21] Appl. No.: 80,442

[22] Filed: Jul. 31, 1987

Related U.S. Application Data

[63] Continuation-in-part of Ser. No. 747,765, Jun. 24, 1985, Pat. No. 4,683,729.

[51] Int. Cl.[4] ..... E05B 73/00

[52] U.S. Cl. ..... 70/58; 70/14; 70/18; 70/232; 70/229

[58] Field of Search ..... 70/14–18, 70/58, 59, 229, 232, 26, 39, 169, 173; 211/4, 5, 8; 248/119.4

[56] References Cited

U.S. PATENT DOCUMENTS

| | | | |
|---|---|---|---|
| 1,021,456 | 3/1912 | Evans | 70/26 |
| 1,291,228 | 1/1919 | Steen | 70/26 |
| 1,461,725 | 7/1923 | Cooper | 70/18 |
| 1,815,417 | 7/1931 | Miller | 70/202 X |
| 1,897,922 | 2/1933 | Bradshaw | 70/26 |
| 2,983,133 | 5/1961 | Hruby | 70/39 X |
| 3,636,739 | 1/1972 | Smedley | 70/39 |
| 3,915,335 | 10/1975 | Shanklin et al. | 70/169 X |
| 4,112,716 | 9/1978 | Wippich | 70/39 X |
| 4,426,861 | 1/1984 | Chillis | 70/39 |
| 4,480,450 | 11/1984 | Brown | 70/14 |
| 4,524,591 | 6/1985 | Lanka | 70/39 X |
| 4,683,729 | 8/1987 | Rogers | 70/58 |

FOREIGN PATENT DOCUMENTS

| | | | |
|---|---|---|---|
| 147299 | 7/1902 | Fed. Rep. of Germany | 70/26 |
| 2133830 | 8/1984 | United Kingdom | 70/69 |

*Primary Examiner*—Robert L. Wolfe
*Assistant Examiner*—Suzanne L. Dino
*Attorney, Agent, or Firm*—Robert C. Tucker; William David Kiesel; Timothy J. Monahan

[57] ABSTRACT

An anti-theft lock for a riding saddle is provided comprising a lock ring which is lockable around a sadle horn. The diameter of the lock ring is greater than that of the neck of the saddle horn, but less than that of the cap of the saddle horn. The lock ring may be tethered to an anchor or other fixed object.

6 Claims, 3 Drawing Sheets

ANTI-THEFT APPARATUS FOR A RIDING SADDLE

This is a continuation-in-part of copending application Ser. No. 747,765, filed on June 24, 1985, now U.S. Pat. No. 4,683,729.

BACKGROUND OF THE INVENTION

1. Field of the Invention

This invention relates in general to locking devices and more particularly to such devices adapted to prevent the theft of a riding saddle.

2. Description of the Prior Art

Riding saddles are inherently high priced with costs ranging easily to $1,000.00 per unit. Saddles are also relatively compact and easy to transport. These factors make saddles high theft items when coupled with the aspect that they can be readily resold or used by the thief. Saddles are frequency used in public places (i.e. horse shows, rodeos, parades, etc.). Consequently, saddles are frequently exposed to conditions which make them susceptible to theft. Saddle owners naturally subject their saddles to theft because a saddle is just large enough that the owner will not always attempt to keep it nearby. If the saddle cannot be kept on the horse of conveniently locked inside a vehicle, it is left exposed in a pickup or trailer bed, over a bale of hay, or on the ground. When so exposed, they may be easily and quickly carried off or simply placed into a car trunk making felonious removal easy for the thief.

This problem has existed for years upon years with no solution other than placing the entire saddle in a secured area. The many sizes and styles of available saddles add to the problem. A device is needed which will deter or prevent saddle theft while not encumbering the saddle owner with burdensome security measures.

No disclosures were discovered in the prior art which addressed the above described problem. There have been applications of locking mechanisms to deter theft of airplaces, skis, bicycles, and umbrellas as well as other locking mechanisms, disclosed in the following patents:

| U.S. PAT. NO. | INVENTOR | ISSUED | TITLE |
|---|---|---|---|
| 4,167,862 | T. Gould | 9/18/79 | ANTI-THEFT DEVICE FOR AIRCRAFT |
| 3,590,608 | C. Smyth & H. Smyth | 7/06/71 | LOCKING DEVICE |
| 527,418 | C. Free & N. Heath | 10/16/1894 | BICYCLE-LOCK |
| 662,334 | E. Appleby | 11/20/1900 | UMBRELLA LOCK |
| 1,823,697 | C. Nenstiehl | 9/15/31 | HANDCUFFS |
| 2,510,294 | A. Rivolier | 6/06/50 | MANACLES |
| 1,872,857 | H. Wesson & E. Pomeroy | 8/23/32 | POLICE OFFICER'S SHACKLE |
| 274,788 | J. King | 3/27/1883 | MAT-LOCK |

SUMMARY OF THE INVENTION

It is therefore an object of this invention to provide a simple, inexpensive, and lightweight anti-theft apparatus for a riding saddle. It is also an object of this invention to provide such an apparatus which may be applied to all types, models, and sizes of saddles. It is further an object of this invention to design an anti-theft apparatus which cannot be easily removed by a thief. It is still another object of this invention to deter theft by providing an anti-theft locking mechanism that, when forcibly removed, would detract from the value of the saddle. It is still a further object of this invention to make the apparatus of a hardened material which would resist cutting. Other objects and advantages of this invention shall become apparent from the ensuing description of this invention.

Accordingly, an anti-theft apparatus for a riding saddle is provided comprising a lock ring which is lockable around a saddle horn. The diameter of the lock ring is greater than that of the neck of the saddle horn, but less than that of the cap of the saddle horn. The lock ring may be tethered to an anchor or other fixed object. Once the ring is closed around the saddle horn, it may be locked with a padlock or a similar locking mechanism.

DETAILED DESCRIPTION

Figure 1:
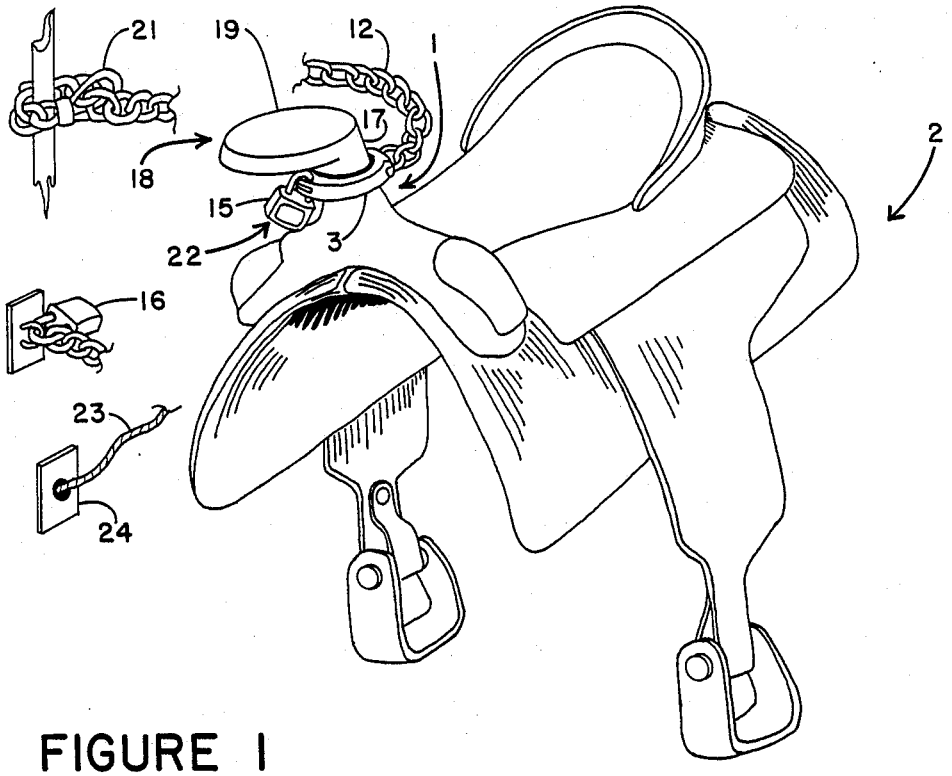
FIG. 1 is a three-dimensional view showing the use of one embodiment of the anti-theft apparatus around a saddle horn.
Figure 2:
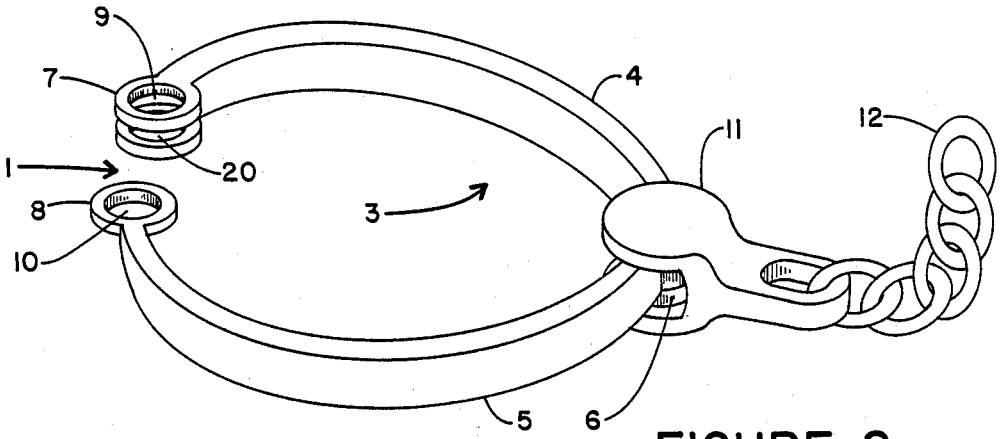
FIG. 2 is a detailed perspective view showing a preferred embodiment of the anti-theft apparatus removed from the saddle horn.

Referring now to the drawings, and more particularly to FIG. 1, a saddle locking apparatus 1 is illustrated in closed position on a saddle horn 18. Referring to FIGS. 1 and 2, the saddle locking apparauts 1 comprises a lock ring 3 which is lockable around the neck 17 of saddle horn 18. The ring 3 must have a diameter greater than that of neck 17, but smaller than that of cap 19, such that the apparatus 1 may not be removed over the horn 18. By locking lock ring 3 around the neck 17 of the saddle horn 18, problems with variations in saddle stype are greatly reduced, since saddle horns 18 are generally made according to only a few standard sizes. In a preferred embodiment, lock ring 3 is divided into segments 4 and 5 which are operatively connected to hinge 6. Segments 4 and 5 are arcuate in shape and are of a configuration such that their respective ends 7 and 8 clasp together and have apertures 9, 10 and 20 which, when aligned, allow for insertion of a padlock locking bar 15. Still more preferably, hinge 6 is enclosed by a connector 11 attachable to a tether 12. Tether 12 is preferably a cable or case-hardened chain. The opposite end of the tether 12 is connected to an anchor such as an enclosing loop 21 or second locking mechanism 16. Other embodiments of tether 12 are possible, such as a retractable cable 23 with its retraction mechanism located within an enclosure 24, such as a horse trailer or truck to prevent tampering.

Figure 3:
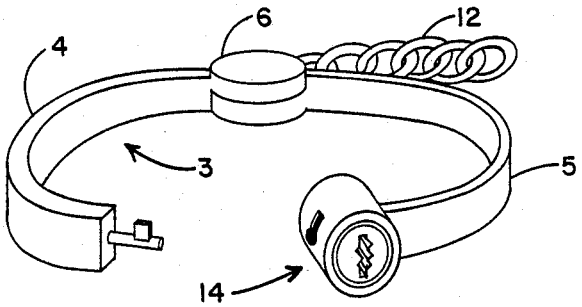
FIG. 3 shows an alternate embodiment of the invention whereby a locking mechanism is fixedly connected to the lock ring.
Figure 4:
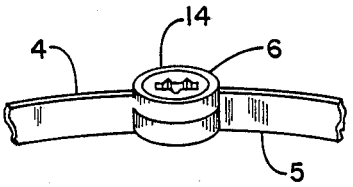
FIG. 4 shows an alternate embodiment of the invention whereby a locking mechanism is incorporated into the hinge of the lock ring.

A second preferred embodiment is shown in FIG. 3 whereby the need for a padlock or simlar external locking mechanism is alleviated by integral locking mechanism 14, fixedly connected to lock ring 3. Another embodiment (not shown) would entail placing the locking mechanism in a protective casing so that a bolt cutter or similar device would not be effective in opening the lock. Locking mechanism 14 also could be integrally incorporated into hinge 6 and/or connector 11. Lock ring 3 could take various forms so long as it is lockable around saddle horn neck 17 and has a diameter less than that of saddle horn cap 19.

It is preferred that lock ring 3 be of a precise configuration so as to just fit around the neck 17 of saddle horn 18. Such a configuration will provide additional protection, since a tight fitting lock ring 3 will be difficult to tamper with. For example, it would be difficult to apply bolt cutters or saw the lock ring 3 without damaging the saddle 2. Also, even if the thief were to successfully detach the tether 12, commonly used cutting means, such as cutting torches, would severaly damage the saddle 2. The prospect of so damaging the stolen merchandise will even further deter theft. A further deterrant may be provided by selecting a padlock 22 having a locking bar 15 with a curvature such that it will just fit through apertures 8, 9, and 20, as shown in FIG. 1, thus making it difficult to maneuver lock 22 into a position to facilitate tampering.

As shown by one example in FIGS. 5–8, the device 1 may take various forms. In order to promote strength and discourage tampering, lock ring 3 may comprise a U-shaped first member 30, having legs 42 and 43, and a sliding second member 31. Second member 31 is slidably attached to first member 30 (as seen in FIG. 1 at position 32) such that ring 3 can be locked around a saddle horn (not shown in FIG. 5). Opening 33 may thus be varied in size enabling the device 1 to be fitted tightly around the saddle horn neck (not shown in FIG. 5). One means by which to attach second member 31 to first member 30 incorporates the use of guides 34 protruding inward from first member 30. Second member 31 is provided with corresponding compatible guide grooves 35, allowing second member 31 to slide on guides 34.

Figure 5:
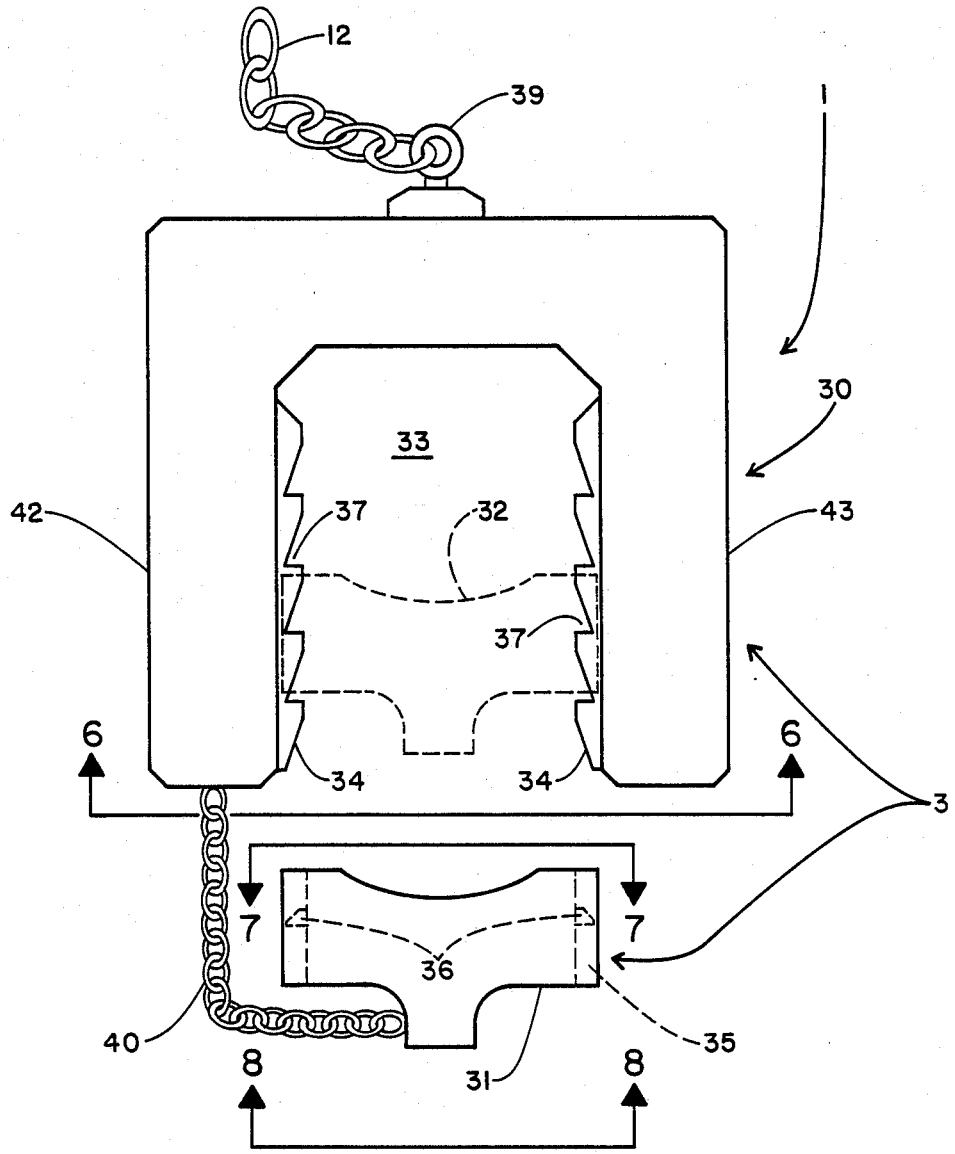
FIG. 5 is a plan view of a preferred embodiment of the invention.
Figure 6:
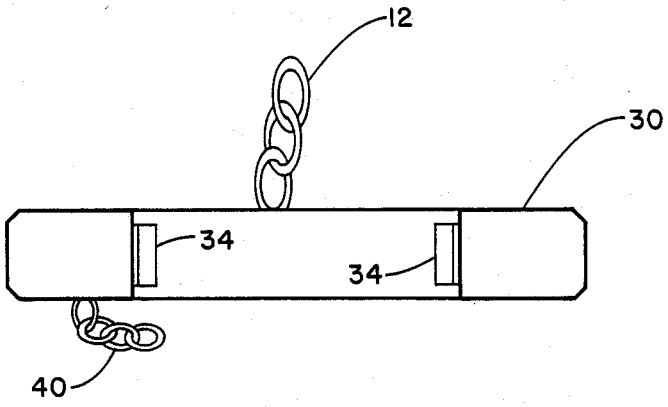
FIG. 6 is a view of the embodiment shown in FIG. 4, taken along view line 6—6.
Figure 7:
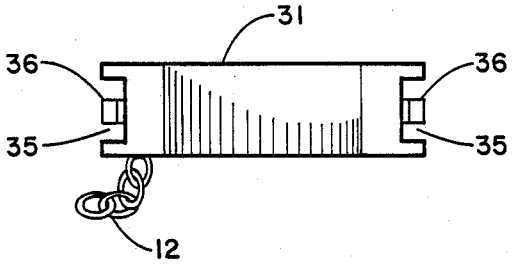
FIG. 7 is a view of the embodiment shown in FIG. 4, taken along view line 7—7.
Figure 8:
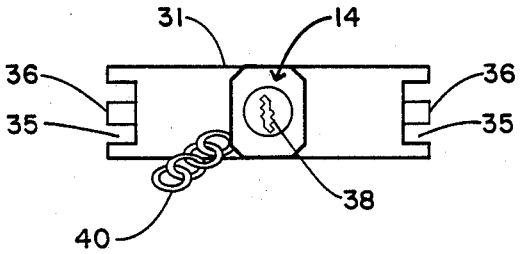
FIG. 8 is a view of the embodiment shown in FIG. 4, taken along view line 8—8.

A means for locking second member 31 to first member 30 is also provided. Such a means for locking (locking mechanism 14) may be provided by incorporating at least one lock bolt 36 within second member 31 as shown in FIGS. 5, 7, and 8. First member 30 is provided with at least one lock bolt recess 37, into which lock bolts 36 may fit, securing second member 31. Preferably, second member 31 is provided with a pair of lock bolts 36, chamferred as shown. Lock bolt recesses 37 preferably take the form of two rows of chamferred recesses 37. If lock bolts 36 are spring-loaded to maintain outward protrusion, second member 31 may then be snapped into a desired snug locked position. A keyway 38 is provided in locking mechanism 14. By turning a key (not shown) in keyway 38 lock bolts 36 may be withdrawn, allowing free movement of second member 31 for locking or unlocking the device 1.

Tether 12 (shown in the form of a chain) is preferably attached to a swivel 39 on first member 30. Security chain 40 prevents loss of second member 31.

Many other variations, modifications, and alternate embodiments may be made in the apparatus and techniques described herein by those having experience in this technology, without departing from the concept of the present invention. Accordingly, it should be clearly understood that the apparatus and methods depicted in the accompanying drawings and referred to in the foregoing description are illustrative only and are not intended as limitations on the scope and spirit of this invention as defined in the following claims.

I claim:

1. In combination with a riding saddle including a saddle horn having a neck, a means for preventing theft of said saddle, comprising a lock ring, said ring being lockable around said neck and connectable to a tether, said ring further comprising:

a. a u-shaped first member having two legs;

b. a second member, slidably positionable between said legs; and c. a locking means for locking the position of said second member relative to said first member.

2. In combination with a riding saddle including a saddle horn having a neck, a means for preventing theft of said saddle according to claim 1, wherein said locking means is incorporated within said second member.

3. In combination with a riding saddle including a saddle horn having a neck, a means for preventing theft of said saddle according to claim 2, wherein said locking means includes at least one retractable lock bolt and at least one said leg is provided with at least one lock bolt recess, alignable with said lock bolt.

4. In combination with a riding saddle including a saddle horn having a neck, a means for preventing theft of said saddle according to claim 3, wherein said second member is provided with two said spring-loaded lock bolts, and outwardly biased, said leg.

5. In combination with a riding saddle including a saddle horn having a neck, a means for preventing theft of said saddle according to claim 4, wherein each said leg is provided with a guide and said second member is provided with a pair of guide grooves, each said guide groove being alignable with one said guide.

6. In combination with a riding saddle including a saddle horn having a neck, a means for preventing theft of said saddle according to claim 5, further comprising a security chain, connected between said first member and said second member.

* * * * *